US008490401B2

(12) United States Patent
Commaret et al.

(10) Patent No.: US 8,490,401 B2
(45) Date of Patent: Jul. 23, 2013

(54) ANNULAR COMBUSTION CHAMBER FOR A GAS TURBINE ENGINE

(75) Inventors: Patrice Andre Commaret, Rubelles (FR); Didier Hippolyte Hernandez, Quiers (FR)

(73) Assignee: SNECMA, Paris (FR)

( * ) Notice: Subject to any disclaimer, the term of this patent is extended or adjusted under 35 U.S.C. 154(b) by 245 days.

(21) Appl. No.: 12/993,379

(22) PCT Filed: Apr. 21, 2009

(86) PCT No.: PCT/FR2009/000474

§ 371 (c)(1), (2), (4) Date: Nov. 18, 2010

(87) PCT Pub. No.: WO2009/144408

PCT Pub. Date: Dec. 3, 2009

(65) Prior Publication Data

US 2011/0088402 A1 Apr. 21, 2011

(30) Foreign Application Priority Data

May 29, 2008 (FR) ..... 08 02919

(51) Int. Cl.
*F02C 1/00* (2006.01)
*F02G 3/00* (2006.01)

(52) U.S. Cl.
USPC ..... 60/755; 60/752; 60/753; 60/754; 60/756; 60/757; 60/758; 60/759; 60/760; 60/742; 60/746

(58) Field of Classification Search
USPC ..... 60/796, 800, 742, 746, 752–760
See application file for complete search history.

(56) References Cited

U.S. PATENT DOCUMENTS

| | | | | |
|---|---|---|---|---|
| 5,142,871 | A * | 9/1992 | Lampes et al. | 60/756 |
| 5,479,774 | A * | 1/1996 | Burnell et al. | 60/804 |
| 6,546,733 | B2 * | 4/2003 | North et al. | 60/772 |
| 6,647,729 | B2 * | 11/2003 | Calvez et al. | 60/753 |
| 6,735,950 | B1 | 5/2004 | Howell et al. | |
| 7,823,387 | B2 * | 11/2010 | Commaret et al. | 60/752 |

FOREIGN PATENT DOCUMENTS

FR 2 889 732 2/2007

OTHER PUBLICATIONS

International Search Report issued Jun. 9, 2010 in PCT/FR09/000474 filed Apr. 21, 2009.

* cited by examiner

*Primary Examiner* — Phutthiwat Wongwian
*Assistant Examiner* — Craig Kim
(74) *Attorney, Agent, or Firm* — Oblon, Spivak, McClelland, Maier & Neustadt, L.L.P.

(57) ABSTRACT

An annular combustion chamber for a gas turbine engine includes radially inner and outer walls connected together by a chamber end wall including openings, each of which receives a fuel injection system. Heat protection deflectors are fastened to the chamber end wall. Holes are formed through the chamber end wall to pass cooling air onto an upstream face of each deflector. The inner or outer edge of a deflector presents a sealing rim engaging the respective inner or outer wall of the chamber.

8 Claims, 3 Drawing Sheets

FIG.1
BACKGROUND ART
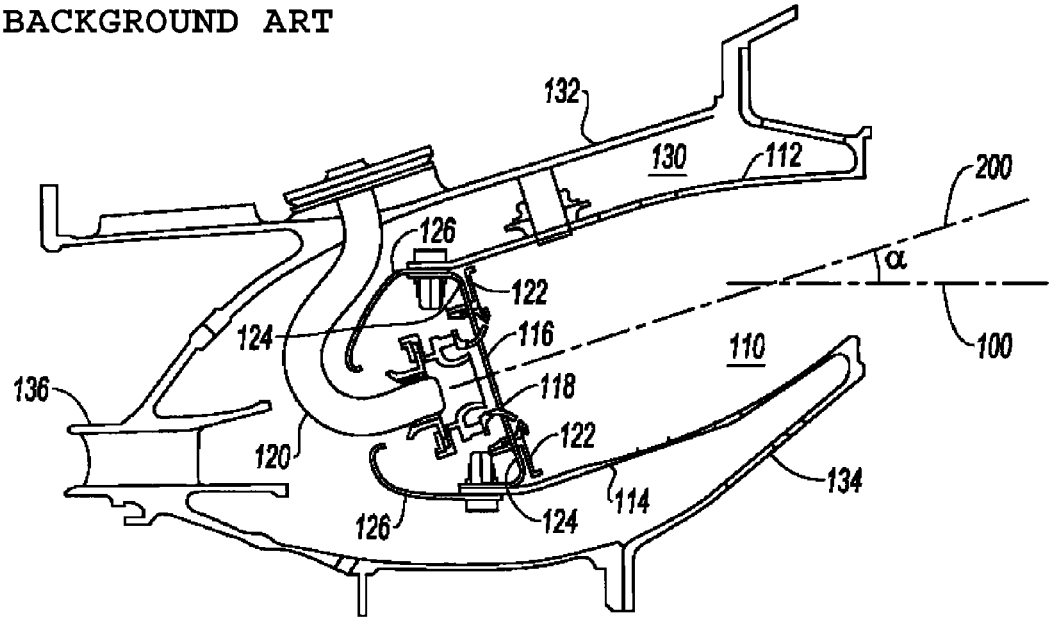
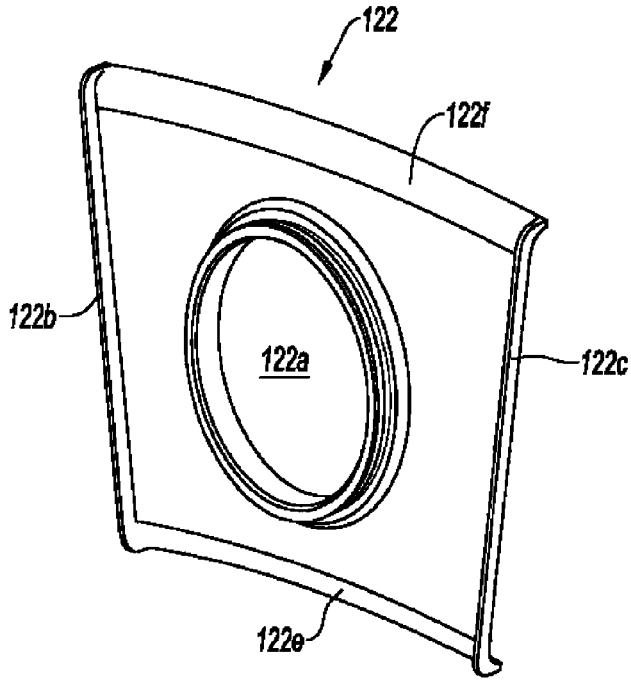
FIG.2
BACKGROUND ART

ANNULAR COMBUSTION CHAMBER FOR A GAS TURBINE ENGINE

BACKGROUND OF THE INVENTION

1. Field of the Invention

The present invention relates to an annular combustion chamber for a gas turbine engine such as a turbojet.

2. Description of the Related Art

FIG. 1 of the accompanying drawings is a longitudinal half-section showing a conventional combustion chamber 110. The other half of the chamber 110 can be derived by symmetry about the axis of the engine (not shown).

The combustion chamber 110 is located downstream from a diffusion chamber 130 constituted by an annular space defined between an outer casing 132 and an inner casing 134, into which diffusion chamber there is introduced an oxidizer, ambient air, that is compressed and that comes from an upstream compressor (not shown) via an annular diffusion duct 136.

In this specification, the terms "upstream" and "downstream" are used relative to the flow direction of gas through the engine.

The combustion chamber 110 has two concentric walls: a radially outer wall 112 (radial relative to the axis of the engine); and a radially inner wall 114; which walls are coaxial and substantially conical so as to provide the connection between the compressor flow section and the turbine flow section. The outer and inner walls 112 and 114 are connected together at the upstream end of the combustion chamber by a chamber end wall 116.

In this example, the chamber 110 is of the divergent type, i.e. the axis 200 of the combustion area diverges at an angle $\alpha$ relative to an axis 100 parallel to the axis of the engine. The outer and inner walls 112 and 114 of the combustion chamber 110 flare going from upstream to downstream.

The chamber end wall 116 is a frustoconical annular part that extends between two transverse planes, flaring from downstream to upstream. The chamber end wall 116 is connected to each of the outer and inner walls 112 and 114 of the combustion chamber 110 and it presents a shape that is slightly conical.

The chamber end wall 116 is provided with a plurality of openings that are angularly distributed around the axis of the engine, each of which receives a system 118 for injecting fuel pre-mixed with combustion air and through which there passes an injector 120 that introduces fuel into the upstream portion of the combustion chamber 110 where combustion reactions take place.

The effect of these combustion reactions is to cause heat to radiate from downstream to upstream towards the chamber end wall 116. Thus, in operation, the chamber end wall is subjected to high temperatures. In order to protect it, sectorized heat screens, referred to as deflectors 122, are interposed between the combustion area and the chamber end wall 116.

As shown in FIG. 2, each deflector 122 is generally in the form of a substantially plane plate made of refractory material and fastened to the chamber end wall 116 by brazing. It has two lateral margins forming rims 122*b* and 122*c* directed towards the chamber end wall 116, a radially outer edge 122*f*, and a radially inner edge 122*e*, together with a central opening 122*a* for passing the injector 120.

The central opening 122*a* is in alignment with one of the openings for receiving an injection system 118 in the chamber end wall 116. The radially inner and outer edges 122*e* and 122*f* of the deflector 122 form two guide nibs or tongues that are curved towards the combustion area and that leave a gap between the inner and outer walls 114 and 112 of the chamber 110.

The deflector 122 is cooled by the impact of jets of cooling air, represented by arrows in FIG. 3, which jets penetrate into the combustion chamber 110 through holes 124 formed in the chamber end wall 116.

The air constituting these jets, while flowing from downstream to upstream, is guided by chamber fairings 126, passes through the chamber end wall 116 via the cooling holes 124, and impacts against the upstream faces of the deflectors 122. The air is then guided radially towards the inside and the outside of the combustion area in order to initiate forming a film for cooling the inner and outer walls 114 and 112 of the chamber 110.

Guidance along the deflectors 122 is provided initially by the side rims 122*b* and 122*c* that extend radially. These rims 122*b* and 122*c* also perform a sealing function. Being in contact with, or leaving minimum clearance relative to, the end wall of the chamber 116, they prevent air from mixing between two adjacent deflectors 122, penetrating into the combustion area, and disturbing combustion.

Thereafter, the sheets of air for cooling the inner and outer walls 114 and 112 of the chamber 110 are initiated by the inner and outer guide nibs 122*e* and 122*f* of each deflector 122.

Unfortunately, it has been observed that hot points become distributed in regular manner around the circumference of the inner and/or outer walls 114 and/or 112 of the chamber 110, in particular in the radial planes containing the axes of the injectors 120.

BRIEF SUMMARY OF THE INVENTION

The present invention seeks to avoid these hot points forming by proposing an annular combustion chamber for a gas turbine engine that enables the guidance of the sheets of cooling air to be optimized over the radially inner and outer walls of the chamber.

To this end, the invention provides an annular combustion chamber for a gas turbine engine, the combustion chamber comprising a radially inner wall and a radially outer wall connected together by an end wall of the combustion chamber, the chamber end wall being provided with openings, each for receiving a fuel injection system, heat protection deflectors being fastened on said chamber end wall, each deflector being in the general shape of a plate presenting a central opening, a radially outer edge, and a radially inner edge, holes being formed in the chamber end wall to allow cooling air to pass over an upstream face of each deflector, the combustion chamber being characterized in that at least one of the radially outer and inner edges of a deflector presents a sealing rim engaging the corresponding radially outer or inner wall of the combustion chamber.

Thus, depending on whether it is located on the radially inner edge of the deflector (or the radially outer edge), the sealing rim directs all of the cooling air delivered through holes in the chamber end wall towards the radially outer wall of the combustion chamber (or towards radially inner as the case may be).

In an advantageous embodiment, compatible with one or the other or each of the two above configurations, the sealing rim presents a flow slot disposed so as to guide a flow of cooling air on the corresponding radially inner (or outer) wall of the chamber towards a determined radial plane. The determined radial plane may advantageously contain the general axis of the corresponding injection system and the flow slot may be arranged at the center of the sealing rim.

Thus, with this flow slot arranged in the sealing rim, the invention enhances the flow of cooling air over the inner and/or outer wall of the combustion chamber level with the axes of the injectors, thus making it possible to avoid forming hot points in these regions. Naturally, this solution can be applied at any point around the circumference of the inner and outer walls of the combustion chamber, and not only at the axes of the injectors.

The radially inner or outer edge of the deflector may have the shape of a curved guide nib (or tongue) with said sealing rim being formed at the periphery thereof.

The invention also provides a gas turbine engine including a combustion chamber as defined above.

BRIEF DESCRIPTION OF THE DRAWINGS

The invention can be better understood and other details, characteristics, and advantages thereof appear more clearly in the light of the following description of three embodiments given in non-limiting manner and with reference to the accompanying drawings, in which:

FIG. 1 (described above) is an axial half-section view of a divergent type conventional combustion chamber;

FIG. 2 (described above) is a perspective view of a prior art deflector used for providing heat protection for the combustion chamber end wall;

DETAILED DESCRIPTION OF THE INVENTION

Figure 3:
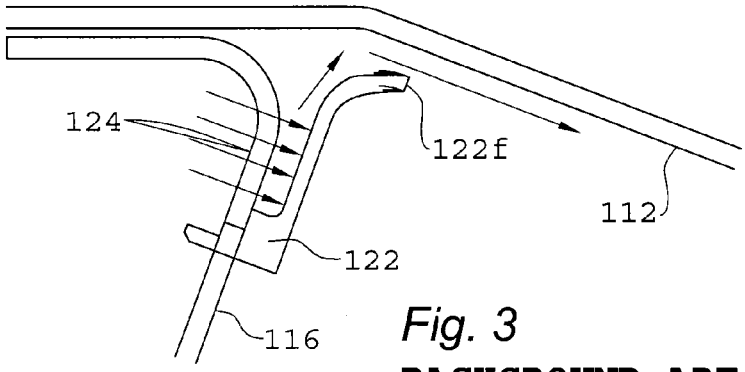
Fig. 3 BACKGROUND ART
FIG. 3 (described above) shows a detail of FIG. 1.

Below, elements corresponding to elements described above with reference to FIGS. 1 to 3 are designated by the same numerical references minus 100.

Thus, as described above, the combustion chamber of the present invention comprises a radially inner wall 14 and a radially outer wall 12, both connected together by a frusto-conical wall forming an end wall 16 of the combustion chamber 10.

The chamber end wall 16 is provided with a plurality of openings, each receiving a fuel injection system 18.

Heat protection deflectors 22 are fastened on the chamber end wall 16. Each deflector 22 is generally in the form of a plate presenting a radially outer edge 22*f*, a radially inner edge 22*e*, and a central opening 22*a* that is aligned with one of the openings for receiving an injection system 18 in the chamber end wall 16.

Holes 24 provided in the chamber end wall 16 allow cooling air to pass over an upstream face of each deflector 22.

Figure 4:
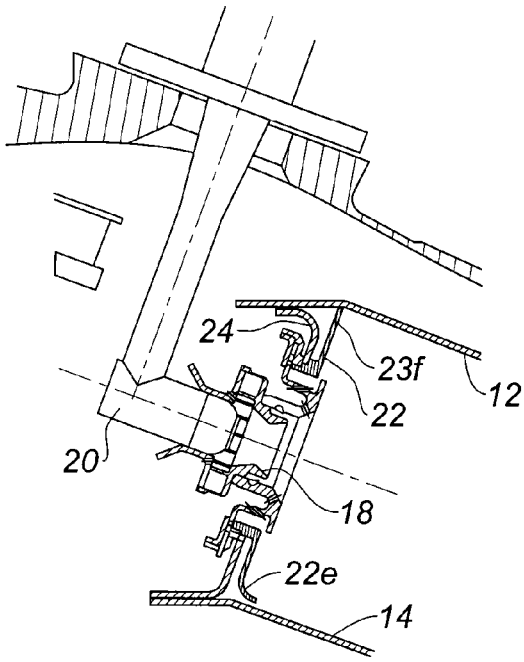
FIG. 4 is a view of a chamber end wall analogous to FIG. 1 and constituting a first embodiment of the invention.
Figure 5:
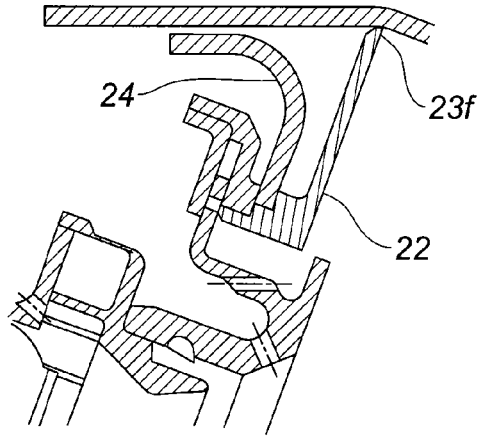
FIG. 5 is a view analogous to FIG. 3 and shows a detail of FIG. 4.

In the embodiment of the invention shown in FIGS. 4 and 5, the radially outer edge of the deflector 22 forms a sealing rim 23*f* for providing sealing between the deflector 22 and the radially outer wall 12 of the combustion chamber.

The radially inner edge 22*e* of the deflector 22 remains in accordance with the prior art, i.e. it leaves a gap relative to the inner wall 14 of the chamber 10 and forms a guide nib or tongue curved towards the combustion area so as to initiate the formation of a film of air for cooling the inner wall 14.

Thus, the presence of the sealing rim 23*f* engaging the outer wall 12 sends all of the cooling air delivered through the holes 24 towards the radially inner wall 14 of the combustion chamber.

Alternatively, and still in accordance with the invention, it is possible to form the sealing rim at the radially inner edge 22*e* of the deflector 22 and to conserve a guide nib against the outer edge 22*f* so as to guide all of the cooling air towards the outer wall 12 of the combustion chamber.

Figure 6:
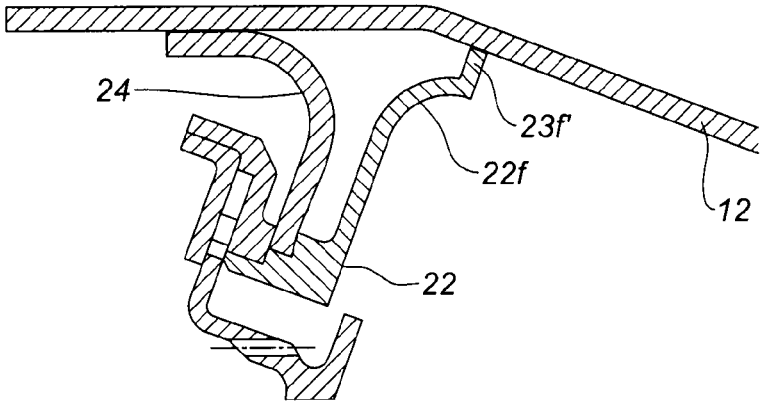
FIG. 6 is a view analogous to FIG. 5 and shows a second embodiment of the invention.

FIG. 6 shows a variant embodiment of the sealing rim 23*f'* engaging the radially outer wall 12 of the combustion chamber. Here, the radially outer edge 22*f* is in the form of a conventional curved guide nib connected to the sealing rim 23*f'*.

Figure 7:
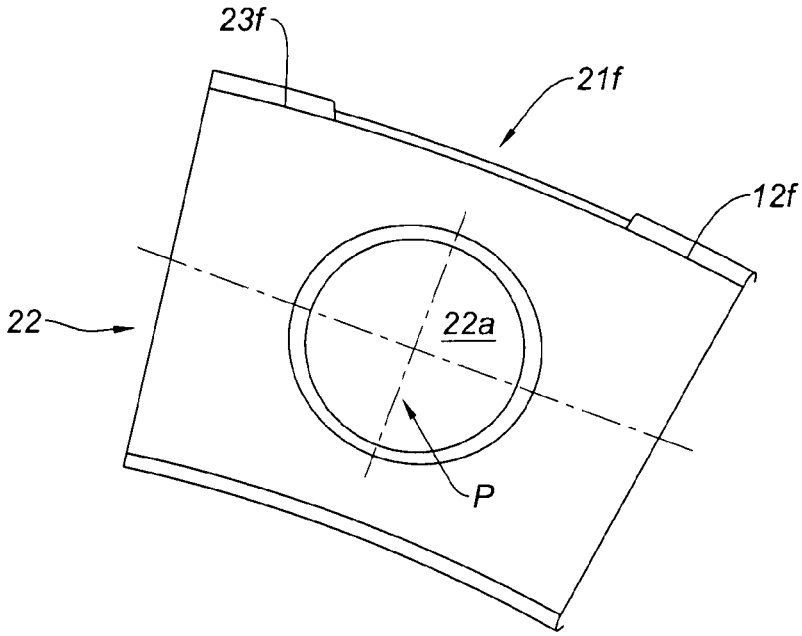
FIG. 7 is a face view of a deflector in a third embodiment of the invention.

In the embodiment shown in FIG. 7, the radially outer edge of the deflector 22 includes a partial sealing rim 23*f* or 23*f'*, i.e. this wall does not extend over the entire length of the outer edge of the deflector 22 as in the two above-described examples, but presents a central flow slot 21*f* disposed so as to guide the cooling air towards a determined radial plane P containing the general axis of the corresponding injection system 18.

The flow of cooling air as channeled into this region of the wall 12 by the flow slot 21*f* serves to avoid hot points forming.

As shown in FIG. 7, the slot 21*f* may extend over a substantial fraction of the length of the rim 23*f*, e.g. over 30% to 70% of said length.

The radially inner edge of the deflector 22 may likewise include a partial sealing rim that is similar in order to guide the cooling air towards a particular axis and avoids forming hot points on the inner wall 14 of the chamber.

Naturally, and as can be seen from the above, the invention is not limited to the particular embodiment described above; on the contrary, it covers any variant embodiment or application coming within the ambit of the following claims.

The invention claimed is:

1. An annular combustion chamber for a gas turbine engine, the combustion chamber comprising:

a radially inner wall and a radially outer wall connected together by an end wall of the combustion chamber, the chamber end wall including a first plurality of openings, each for receiving a fuel injection system;

heat protection deflectors fastened on the chamber end wall, each deflector being in a general shape of a plate presenting a central opening, a radially outer edge, and a radially inner edge;

wherein a second plurality of openings is formed in the chamber end wall to allow cooling air to pass over an upstream face of each deflector, wherein only one of the radially outer or inner edges of one of the deflectors presents a sealing rim engaging the corresponding radially outer or inner wall of the combustion chamber and the other of the radially outer or inner edges of the one of the deflectors presents a gap relative to the corresponding radially outer or inner wall of the combustion chamber.

2. A combustion chamber according to claim 1, wherein the sealing rim presents a flow slot located so as to guide a flow of cooling air against the corresponding radially inner or outer wall of the combustion chamber towards a determined radial plane.

3. A combustion chamber according to claim 2, wherein the determined radial plane contains a general axis of the corresponding injection system, and the flow slot is formed at a center of the sealing rim.

4. A combustion chamber according to claim 3, wherein the flow slot occupies 30% to 70% of a length of the sealing rim.

5. A combustion chamber according to claim 1, wherein the radial inner or outer edge of the deflector is in a form of a curved guide nib connected at its periphery to the sealing rim.

6. A gas turbine engine including a combustion chamber according to claim 1.

7. A combustion chamber according to claim 1, wherein an outermost surface or an innermost surface of the only one of the radially outer or inner edges of one of the deflectors presenting the sealing rim abuts the corresponding radially outer or inner wall of the combustion chamber.

8. A combustion chamber according to claim 2, wherein the flow slot is recessed from the only one of the radially outer or inner edges of the one of the deflectors presenting the sealing rim.

* * * * *